US009669412B2

(12) United States Patent
Cattivelli

(10) Patent No.: US 9,669,412 B2
(45) Date of Patent: Jun. 6, 2017

(54) MICRONIZING DEVICE FOR FLUID JET MILLS

(75) Inventor: Aleardo Cattivelli, Roveleto di Cadeo (IT)

(73) Assignee: FYDEC HOLDING SA, Ecublens (CH)

( * ) Notice: Subject to any disclaimer, the term of this patent is extended or adjusted under 35 U.S.C. 154(b) by 852 days.

(21) Appl. No.: 14/114,090

(22) PCT Filed: Oct. 10, 2011 (Under 37 CFR 1.47)

(86) PCT No.: PCT/IB2011/054451
§ 371 (c)(1), (2), (4) Date: Jan. 27, 2014

(87) PCT Pub. No.: WO2012/049608
PCT Pub. Date: Apr. 19, 2012

(65) Prior Publication Data

US 2014/0326814 A1 Nov. 6, 2014

(30) Foreign Application Priority Data

Oct. 12, 2010 (IT) ..... MI2010A1864

(51) Int. Cl.
*B02C 19/06* (2006.01)

(52) U.S. Cl.
CPC ..... *B02C 19/061* (2013.01); *B02C 19/06* (2013.01); *B02C 19/066* (2013.01)

(58) Field of Classification Search
CPC ..... B02C 19/06; B02C 19/061; B02C 19/066
USPC ..... 241/5, 39, 41
See application file for complete search history.

(56) References Cited

U.S. PATENT DOCUMENTS

| | | | | |
|---|---|---|---|---|
| 2,032,827 | A * | 3/1936 | Andrews | 241/5 |
| 2,588,945 | A | 3/1952 | Trost | |
| 3,178,121 | A | 4/1965 | Wallace, Jr. | |
| 3,462,086 | A | 8/1969 | Bertrand et al. | |
| 2005/0051649 | A1 * | 3/2005 | Taketomi et al. | 241/39 |

FOREIGN PATENT DOCUMENTS

| | | | |
|---|---|---|---|
| GB | 1137320 | A | 12/1968 |

* cited by examiner

*Primary Examiner* — Faye Francis
*Assistant Examiner* — Onekki Jolly
(74) *Attorney, Agent, or Firm* — Pearne & Gordon LLP

(57) ABSTRACT

This invention relates to a micronizing device for fluid jet mills which presents a containing body (2) internally delimiting a substantially cylindrical grinding chamber (3), a plurality of nozzles (18), each presenting a mouth (22) opening onto a radially internal side wall (8) of the grinding chamber (3), a supply duct (9) for material to be micronized, opening into the grinding chamber (3) and at least one injection duct (12) for pressurized fluid, in fluid communication with said nozzles (18). The nozzles (18) present a pressurized fluid injection direction (X-X) which is tangent to an imaginary circle included inside the grinding chamber (3). The radially internal side wall (8) presents, at each nozzle (18), a first portion (23) which is substantially perpendicular to the injection direction (X-X) of the respective nozzle (18).

13 Claims, 4 Drawing Sheets

Fig.2
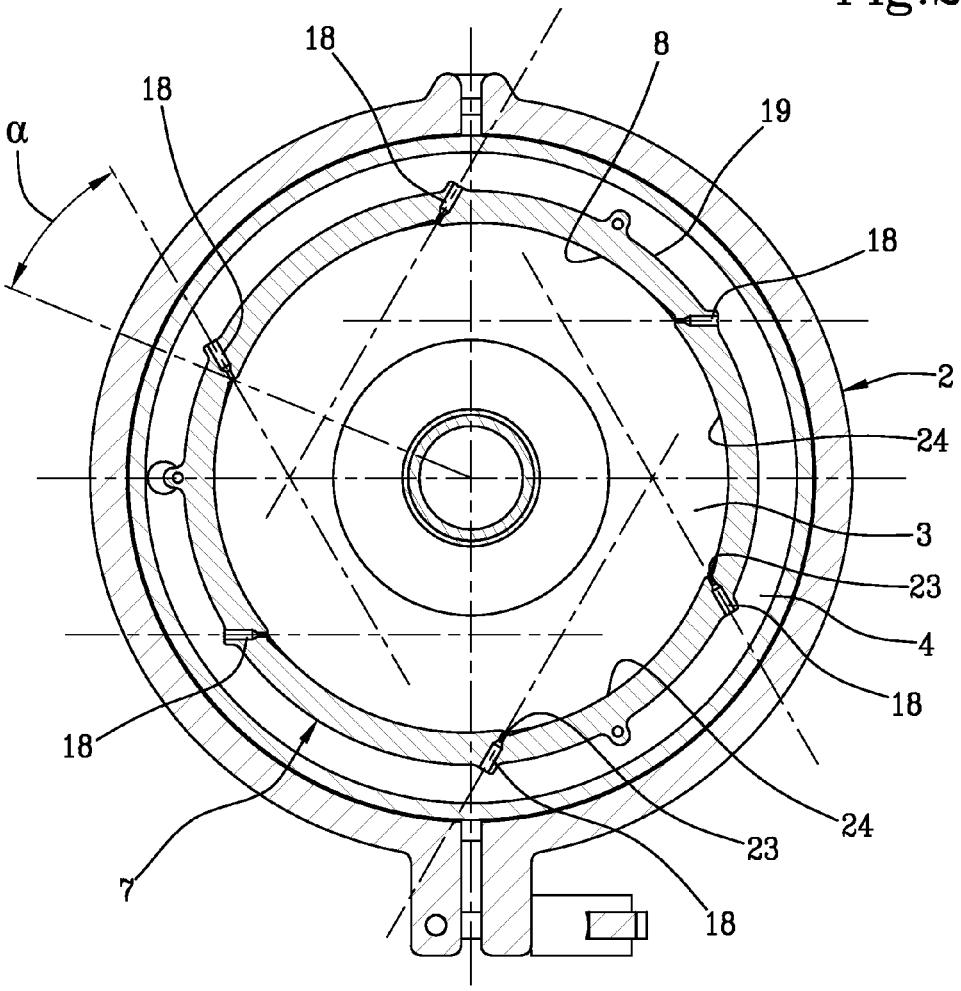
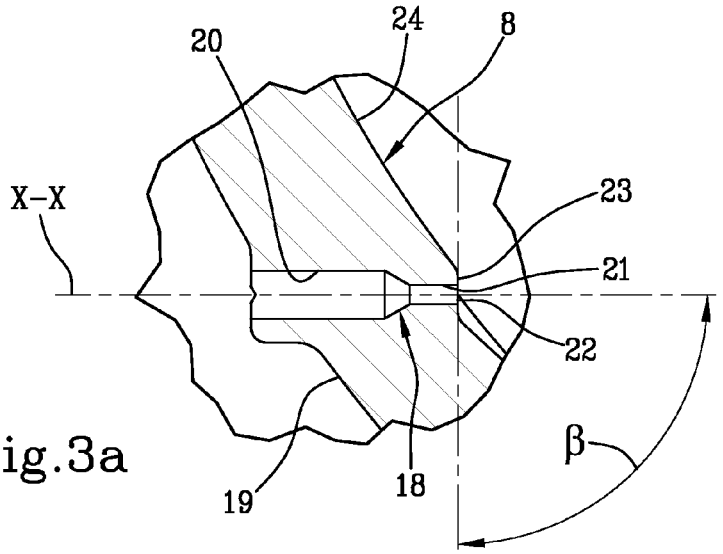
Fig.3a

Fig.5
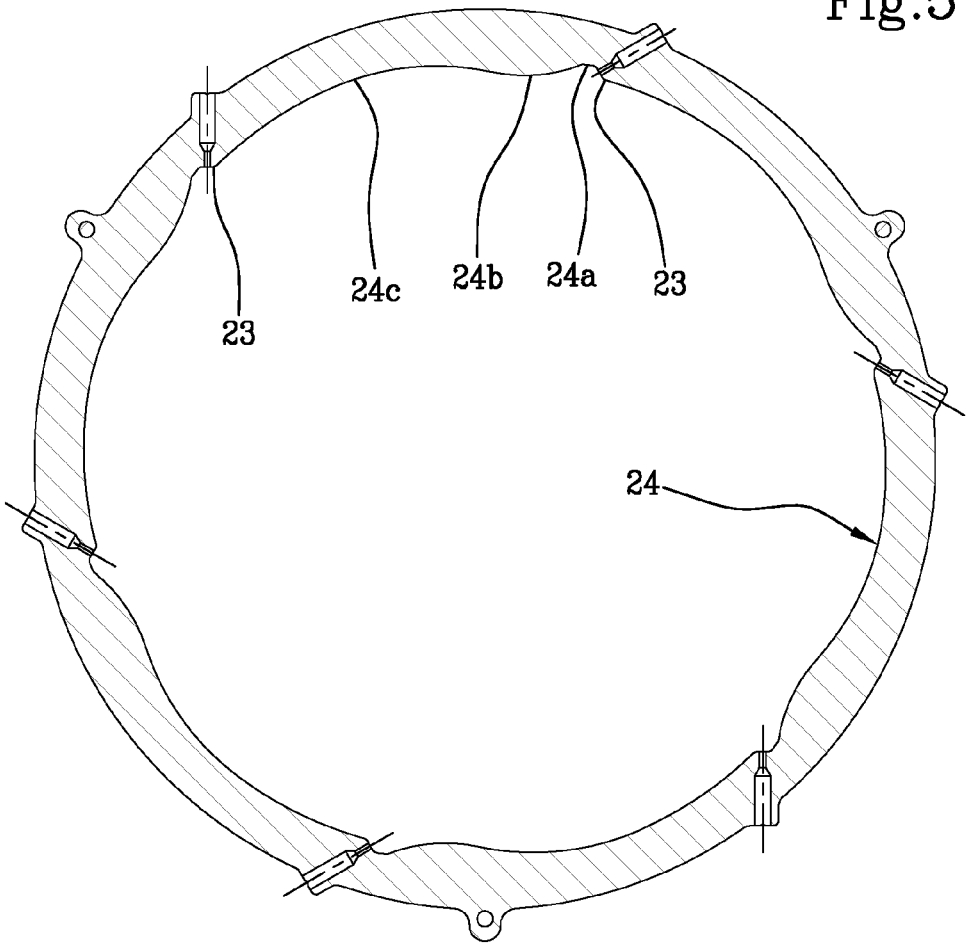
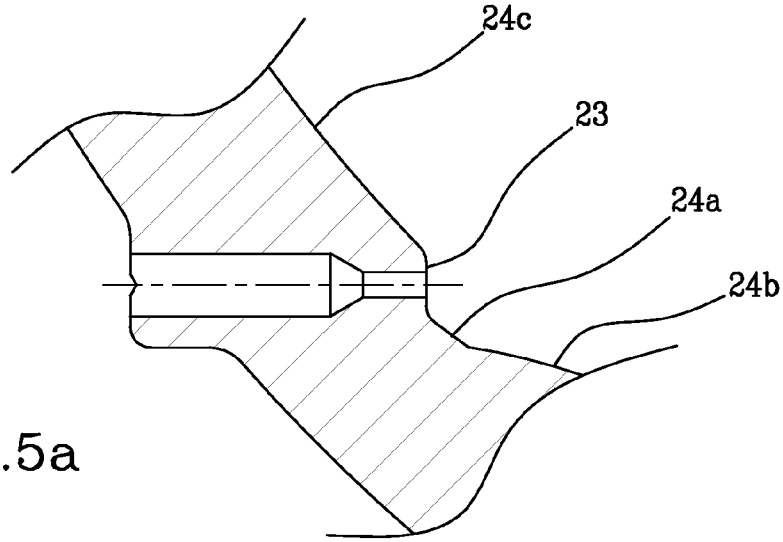
Fig.5a

MICRONIZING DEVICE FOR FLUID JET MILLS

TECHNICAL FIELD

This invention relates to a micronizing device for fluid jet mills.

Fluid jet mills are used for reducing particles of powder material to micron or sub-micron size. Pulverization is obtained by placing the powder material in a grinding chamber in a vortex of pressurized fluid (typically air, steam or an inert gas). The particles collide with each other and with the wall of the chamber and the impacts cause them to break down into smaller sized particles. Fluid jet mills are used, for example, in the chemical, food and pharmaceutical industries for both production and laboratory applications.

SUMMARY OF THE INVENTION

As is known, the grinding chamber of a fluid jet mill has a cylindrical wall against which a plurality of nozzles are directed. The nozzles are arranged in such a way that they are tangent to an imaginary circle inside the cylindrical chamber. The pressurized fluid from the nozzles creates a vortex which converges spirally towards the centre of the chamber and is discharged through an outlet at the centre of the chamber.

To create the vortex, the nozzles are mounted in holes which are inclined to a radial direction and protrude into the chamber from the aforesaid cylindrical wall. This type of chamber is described, for example, in document GB 1,137,320.

The Applicant has observed that protruding nozzles create points or zones of stagnation where the local velocity of the fluid is reduced to zero and where the treated powder can accumulate.

The Applicant has also observed that the powder material tends to settle and accumulate on the radially outer periphery of the grinding chamber, thereby diminishing the efficiency of the mill, wasting material and requiring frequent cleaning.

Moreover, the frequent impacts of the material with the protruding nozzle heads lead to rapid wear and the need to substitute the nozzles frequently.

In this context, the Applicant has addressed the problem of providing a micronizing device for fluid jet mills which is more efficient and economical than those known in the prior art.

More specifically, the Applicant has addressed the problem of providing a micronizing device for fluid jet mills which makes it possible to reduce or eliminate the accumulation of material in the grinding chamber during operation.

The Applicant has also addressed the problem of providing a micronizing device which requires less maintenance and reduces the need to substitute parts of it during its working life.

The Applicant has also addressed the problem of providing a micronizing device with lower production costs.

According to this invention, it has been found that by shaping the inside wall of the grinding chamber in such a way that each nozzle faces a part of the wall that is substantially perpendicular to the axis of the nozzle, it is possible to reduce material accumulation and enhance the efficiency of the mill.

More specifically, according to a first aspect of it, this invention relates to a micronizing device for fluid jet mills, comprising:

a containing body internally delimiting a substantially cylindrical grinding chamber;

a plurality of nozzles, each presenting a mouth which opens onto a radially internal side wall of the grinding chamber;

a supply duct for material to be micronized, opening into the grinding chamber;

at least one injection duct for pressurized fluid, in fluid communication with said nozzles;

where said nozzles present a pressurized fluid injection direction which is tangent to an imaginary circle included inside the grinding chamber;

characterized in that the radially internal side wall presents, at each nozzle, a first portion which is substantially perpendicular to the injection direction of the respective nozzle.

According to a second aspect of it, this invention relates to a micronizing ring for micronizing devices for fluid jet mills, comprising: a plurality of nozzles, each presenting a mouth which opens onto a radially internal side wall of said ring;

where said nozzles present a pressurized fluid injection direction which is tangent to an imaginary circle included inside the ring;

characterized in that the radially internal side wall presents, at each nozzle, a first portion which is substantially perpendicular to the injection direction of the respective nozzle.

In at least one of the above mentioned aspects of it, this invention may also have one or more of the preferred features described hereinafter.

Preferably, each first portion makes with the respective injection direction an angle of between about 85° and about 95°, preferably between about 88° and about 92°.

According to a preferred embodiment, the radially internal side wall presents second curved portions which are placed between the first portions.

The second curved portions connect two consecutive first portions to create to an annular saw tooth profile. Each of the second curved portions has a centre which is offset relative to the cylindrical chamber. This shape makes it possible to diminish the effect of the jet emitted by one nozzle on the jet emitted by the next nozzle and to reduce the number of impacts of the whirling material against the mouth of each nozzle.

Each first portion forms a concave edge with one of the second curved portions and a convex edge with the other. Each of the second curved portions preferably does not have sharp edges. By annular saw tooth profile is meant a profile where the concave edge connecting each second curved portion to a first portion is located at a radial position (relative to the centre of the micronizing ring) which is further out than the convex edge connecting the same second curved portion to the other first portion.

In a variant embodiment, each of the second curved portions, while maintaining the overall saw tooth shape of the radially internal wall, has at least one concave part and at least one convex part. Preferably, there is only one convex part on a circular arc shaped portion which connects two successive first portions. The position of the convexity and its radial and circumferential extension are designed to reduce the number of points where material can accumulate. Preferably, the convexity, or bump, is closer to the concave connecting edge and further away from the convex connecting edge.

Preferably, the mouth of each nozzle opens flush with the respective first portion.

The absence of recesses and interstices, that is to say, of stagnation points, prevents accumulation of material.

Further, since the nozzle heads do not protrude, the abrasive effect of the powder material on them is greatly reduced.

Preferably, the mouth of each nozzle is substantially circular.

The fluid jet is more uniform and precisely directed.

Preferably, each nozzle is a hole made directly in the radially internal side wall.

Since the nozzles are not separate parts inserted into housings made in the wall but are made directly in the wall, the holes are much smaller in size than prior art nozzle housings and thus the height of the wall can be reduced, thereby reducing accumulation in the radially peripheral zones of the chamber.

Moreover, since the holes are machine made, it is not necessary for the operator to install nozzles in the wall, with the risk of making assembly errors, for example forgetting to a fit a nozzle, as in the case of prior art devices.

The absence of separate nozzles to be fitted in the chamber also allows savings on assembly time and material.

Preferably, the device comprises a micronizing ring inserted in removable manner in the containing body and bearing the radially internal side wall of the grinding chamber.

The ring can be easily substituted with a new one or one suitable for the characteristics of the material to be milled or it can be temporarily removed for maintenance purposes.

Moreover, since it is a separate component, the shaping of the side wall and nozzles is quick and easy.

Preferably, each nozzle is a through hole made directly in the ring.

The nozzles are quick and easy to make, thus reducing production costs.

Preferably, the ring is made from a sheet or slab of plastic material (for example, PTFE, PEEK, HDPE) preferably by water jet or laser cutting. Thanks to the non-stick properties of PTFE, product accumulation is reduced.

As a whole, the ring production process is fast, with obvious advantages in terms of higher productivity and lower costs.

BRIEF DESCRIPTION OF THE DRAWINGS

Other features and advantages will become more apparent from the detailed description of a preferred non-limiting embodiment of a micronizing device for fluid jet mills according to this invention.

The description is set out below with reference to the accompanying drawings which are provided solely for purposes of illustration without limiting the scope of the invention and in which:

FIG. 2 is a cross sectional plan view of the device of FIG. 1;

FIG. 3*a* is an enlarged detail of the device of FIG. 2;

FIG. 5 is a cross sectional plan view of a variant embodiment of the component of FIG. 4;

FIG. 5*a* is an enlarged detail of the component of FIG. 5.

Figure 1:
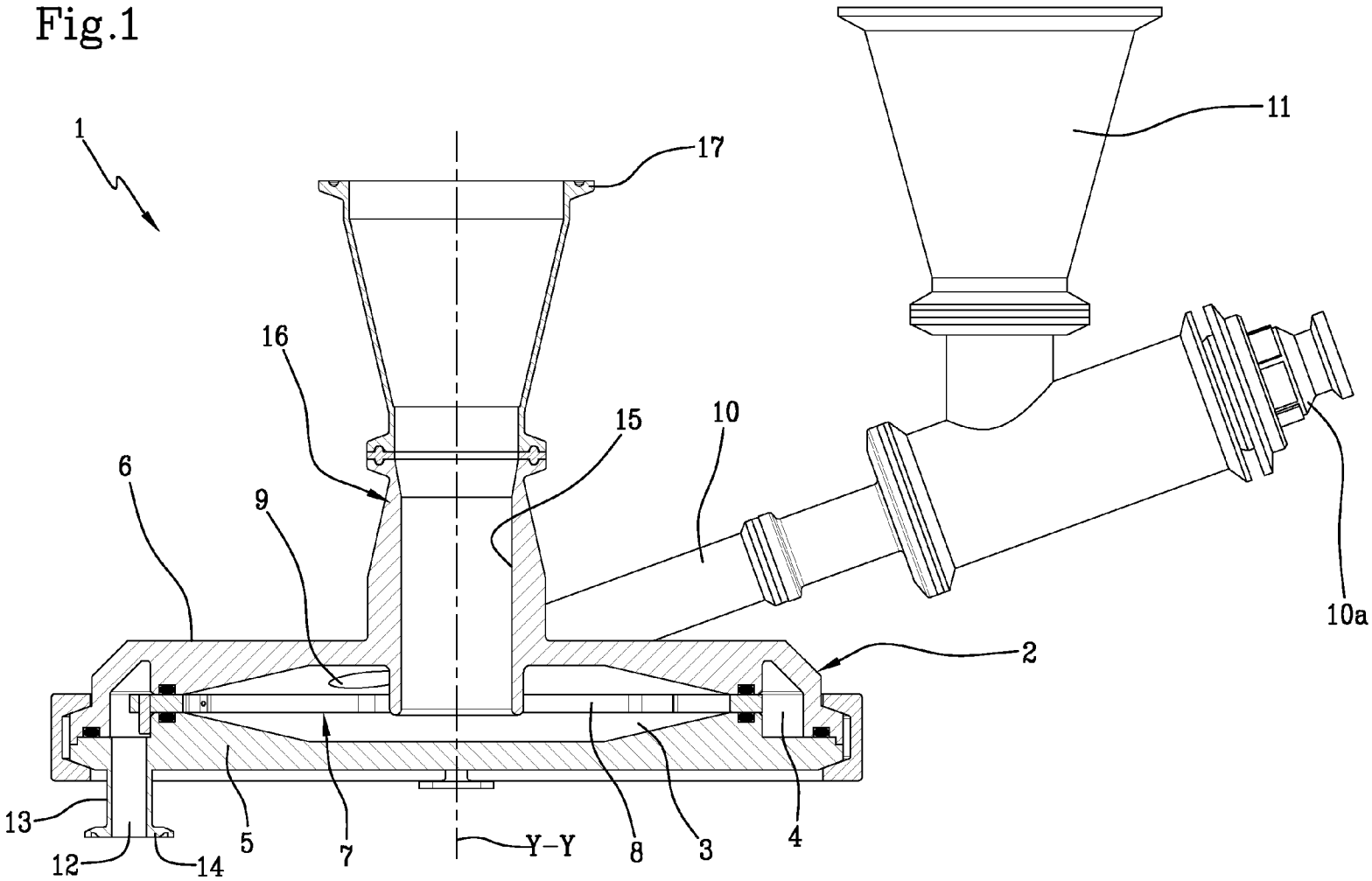
FIG. 1 is a cross sectional side elevation view of the micronizing device for fluid jet mills according to the invention.

The reference numeral 1 denotes in its entirety a micronizing device for fluid jet mills according to this invention.

A fluid jet mill comprises the micronizing device 1, mounted on a supporting frame, not illustrated because it is of a per se known type, and connected to a feeder of material to be milled, to a collector of the milled material and to other devices of known type and therefore not illustrated. The mill also comprises a suitable process control unit of a per se known type.

With reference to FIG. 1, the micronizing device 1 illustrated comprises a containing body 2 made of stainless steel or of a plastic material. The containing body 2 is substantially cylindrical in shape and internally delimits a grinding chamber 3, also substantially cylindrical in shape, and an annular collector 4 which extends all the way round the chamber 3. In the embodiment illustrated, the containing body 2 is defined by a lower, cup-shaped part 5 closed at the top by a lid 6. The lower cup-shaped part 5 houses, preferably in a removable manner, a micronizing ring 7 which separates the chamber 3 from the annular collector 4. The grinding chamber 3 is delimited at the bottom by the cup-shaped part 5, at the top by the lid 6 and laterally by a side wall 8 which is radially inside the ring 7. The grinding chamber 3 is in diameter approximately 5 to 9 times its maximum height. The grinding chamber 3 may be made with a nominal diameter of between about 20 mm and about 700 mm.

The micronizing device 1 comprises a supply duct 9 which opens into the grinding chamber 3. In the embodiment illustrated, the supply duct 9 is delimited by a first tubular element 10 which extends obliquely from the lid 6. A free end 10*a* of the first tubular element 10, opposite the lid 6, is in fluid communication with a source of pressurized fluid, not illustrated. A hopper 11 is mounted above the first tubular element 10 and the bottom of it is in communication with the supply duct 9.

The micronizing device 1 comprises an injection duct 12 which opens into the annular collector 4. In the embodiment illustrated, the injection duct 12 is delimited by a second tubular element 13 which extends away from the lower cup-shaped part 5. A free end 14 of the second tubular element 13, opposite the lower cup-shaped part 5, is in fluid communication with a source of pressurized fluid, not illustrated.

The micronizing device 1 comprises a discharge duct 15 which opens into the grinding chamber 3. In the embodiment illustrated, the discharge duct 15 is delimited by a third tubular element 16 which extends vertically from the lid 6 and is coaxial with the main axis "Y-Y" of the cylindrical containing body 2 and of the ring 7. A free end 17 of the third tubular element 16, opposite the lid 6, communicates with a separating device (gas/product), not illustrated.

In a variant embodiment not illustrated the product is separated from the process gas directly in the grinding chamber 3. In this variant embodiment, the micronizing device 1 comprises a further duct which opens into the grinding chamber 3, extends downwardly from the lower cup-shaped part 5 and is coaxial with the main axis "Y-Y". The product is discharged into the lower zone through the further duct and collected in a container, while the ultrafine particles are expelled from the upper zone through the discharge duct 15.

The micronizing ring 7 comprises a plurality of nozzles 18 arranged at equal angular intervals about the main axis "Y-Y" of the selfsame ring 7. Each nozzle 18 is a hole made directly in the material the ring 7 is made of and passes through the ring 7 from a radially external side wall 19 to the radially internal side wall 8 (FIGS. 2, 3 and 4).

Figure 3B:
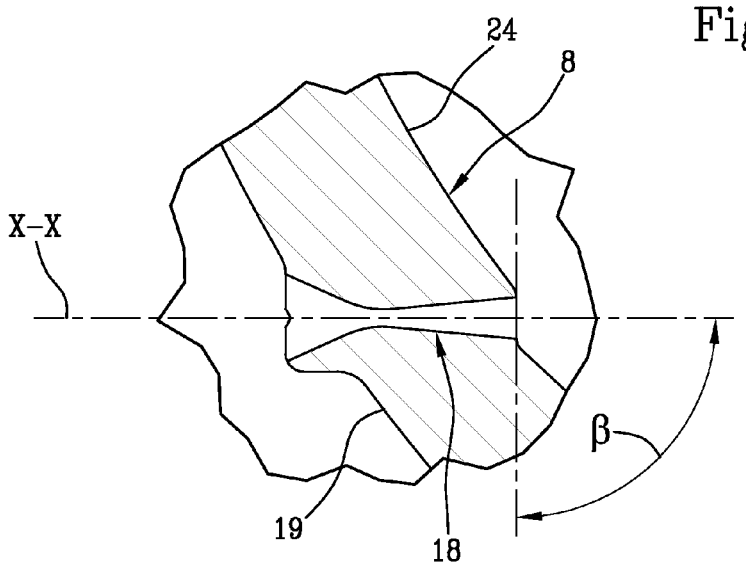
FIG. 3*b* is a variant embodiment of the detail of FIG. 3*a;*
Figure 4:
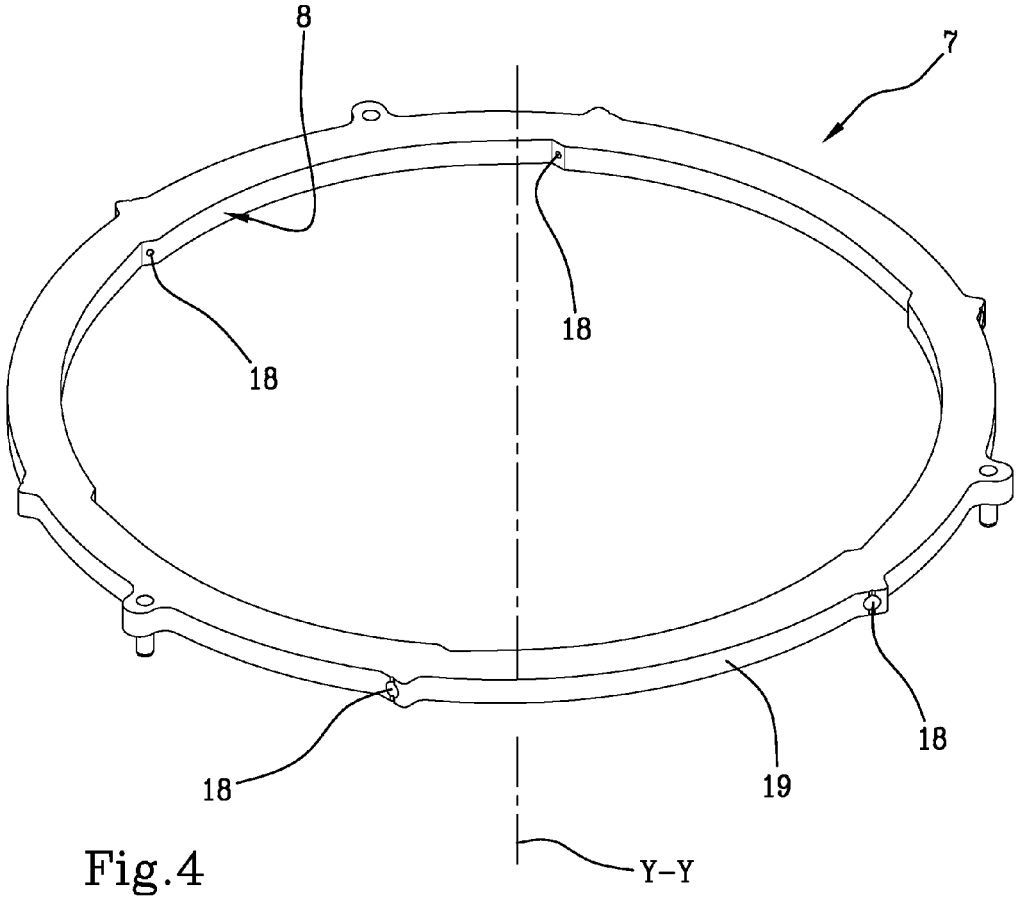
FIG. 4 is a perspective view of a component of the device of the preceding figures.

Each nozzle 18 of the embodiment illustrated in FIG. 3*a* has a first stretch 20 which opens onto the radially external side wall 19 and is larger in diameter, and a second stretch 21 which opens onto the radially internal side wall 8 by way of a mouth 22 and is smaller in diameter. The smaller diameter is between about 0.3 mm and about 5 mm. In the variant embodiment of FIG. 3*b*, the internal profile of the nozzle is of the convergent-divergent type. In other variant embodiments, not illustrated, the internal profile of the nozzle might be different from those illustrated.

Each nozzle 18 is in fluid communication with the annular collector 4 and with the grinding chamber 3.

Each nozzle 18 has a straight axis which defines a pressurized fluid injection direction "X-X" and extends at an angle to the radial direction referenced to the main axis "Y-Y" of the ring 7. Each injection direction "X-X" makes with a radial direction through the mouth of the respective nozzle an angle "α" of between about 30° and about 60°. In other words, the injection directions "X-X" of the nozzles 18 are tangent to an imaginary circle which lies in a plane at right angles to the main axis "Y-Y" of the ring 7, is coaxial with the main axis "Y-Y" and is smaller in diameter than the ring 7, that is to say, which is included inside the grinding chamber 3.

The radially internal side wall 8 has, in a plan view of the ring 7 itself, a saw tooth profile.

More specifically, the radially internal side wall 8 has first portions 23 which the mouth 22 of one of the nozzles 18 opens onto. The mouth 22 opens flush with the respective first portion 23. Each of the first portions 23, preferably flat, is substantially perpendicular to the injection direction "X-X" of the respective nozzle 18, that is to say, it makes with a radial direction passing through it an angle different from 90°. More specifically, each first portion 23 makes with the respective injection direction an angle "β" of between about 85° and about 95°, preferably between about 88° and about 92°, and still more preferably 90°. It follows that, since the hole defining each nozzle 18 is circular, the mouth 22 is substantially circular.

The first portions 23 are connected to each other by second curved portions 24. Each first portion 23 forms a concave edge with one of the second curved portions 24 and a convex edge with the other.

In the variant embodiment of FIG. 5, each second curved portion 24 has a first concave part 24*a* followed by a convex part 24*b* and a second concave part 24*c*. Preferably, the first concave part 24*a* has a circular arc shaped profile and makes a convex edge with the second convex portion or bump 24*b*. The second concave part 24*c* has a circular arc shaped profile and is joined smoothly, without edges, to the second convex portion or bump 24*b*. The convex part 24*b* is substantially a bump on a circular arc shaped portion which connects two successive first portions 23. In the variant embodiment illustrated, the bump 24*b* is closer to the first portion 23 which it makes the concave edge with than it is to the first portion 23 which it makes the convex edge with.

The micronizing ring 7 is preferably made by water jet or laser cutting from a sheet or slab of plastic material.

In use, the material in particles to be micronized is fed through the hopper 11 while the pressurized fluid (for example, inert gas) is supplied through the free end 10*a* of the first tubular element 10 at a pressure of a few bar (2-13 bar). At the same time, the pressurized fluid is fed through the free end 14 of the second tubular element 13 also into the annular collector 4 and from there injected into the grinding chamber 3 through the nozzles 18. The angle of the nozzles 18 produces a high-speed vortex which whirls the material to be micronized round the chamber 3, causing the particles to collide with each other and with the chamber walls, thereby breaking them down into smaller particles. The larger particles are held by centrifugal force in the outermost zone of the vortex until they are broken down into smaller particles, whirled towards the centre and evacuated through the discharge duct 15.

The invention claims is:

1. A micronizing device for fluid jet mills, comprising:

a containing body internally delimiting a substantially cylindrical grinding chamber;

a plurality of nozzles, each presenting a mouth which opens onto a radially internal side wall of the grinding chamber;

a supply duct for material to be micronized, opening into the grinding chamber;

at least one injection duct for pressurized fluid, in fluid communication with said nozzles;

wherein said nozzles present a pressurized fluid injection direction (X-X) which is tangent to an imaginary circle included inside the grinding chamber;

characterized in that the radially internal side wall presents, at each nozzle, a first portion which is substantially perpendicular to the injection direction (X-X) of the respective nozzle;

wherein the radially internal side wall presents second curved portions placed between the first portions;

wherein the second curved portions connect two consecutive first portions to create an annular saw tooth profile;

wherein each of the second portions has one or two concave parts and only one convex part.

2. The device according to claim 1, wherein each first portion makes with the respective injection direction an angle having a magnitude of between 85° and 95°.

3. The device according to claim 1, wherein each of the second curved portions has a center which is offset relative to the cylindrical chamber.

4. The device according to claim 1, wherein the mouth of each nozzle opens flush with the respective first portion.

5. The device according to claim 1, wherein the mouth of each of the nozzles is substantially circular.

6. The device according to claim 1, wherein each nozzle is a hole made directly in the radially internal side wall.

7. The device according to claim 1, comprising a micronizing ring inserted in removable manner in the containing body and bearing the radially internal side wall of the grinding chamber.

8. The device according to claim 1, wherein each of the second curved portions does not have sharp edges.

9. A micronizing ring for micronizing devices for fluid jet mills, comprising:

a plurality of nozzles, each presenting a mouth opening onto a radially internal side wall of said micronizing ring;

where said nozzles present a pressurized fluid injection direction which is tangent to an imaginary circle included inside the micronizing ring;

characterized in that the radially internal side wall presents, at each nozzle, a first portion which is substantially perpendicular to the injection direction of the respective nozzle;

wherein the radially internal side wall presents second curved portions placed between the first portions;

wherein the second curved portions connect two consecutive first portions to create an annular saw tooth profile, wherein said second curved portions have only one concave part and one or two convex parts.

10. The device according to claim 9, wherein each nozzle is a through hole made directly in the ring.

11. The ring according to claim 9, wherein said ring is made of metal sheet by laser cutting.

12. The device according to claim 1, wherein each first portion makes with the respective injection direction an angle having a magnitude of between 88° and 92°.

13. A micronizing device for fluid jet mills, comprising:

a containing body internally delimiting a substantially cylindrical grinding chamber, the containing body comprising a ring, the ring having a radially internal side wall;

a plurality of nozzles, each presenting a mouth which opens onto the radially internal side wall;

a supply duct for material to be micronized, opening into the grinding chamber;

at least one injection duct for pressurized fluid, in fluid communication with said nozzles;

wherein each of said nozzles presents a pressurized fluid injection direction which is tangent to an imaginary circle included inside the grinding chamber;

wherein each of said nozzles consists only of a through hole made directly in the ring and extending through the ring and wherein the radially internal side wall presents, at each nozzle, a first portion which is substantially perpendicular to the injection direction of the respective nozzle;

wherein the radially internal side wall presents second curved portions placed between the first portions;

wherein the second curved portions connect two consecutive first portions to create an annular saw tooth profile;

wherein each of the second portions has one or two concave parts and only one convex part.

* * * * *